US007152650B2

(12) United States Patent
Van Tyle et al.

(10) Patent No.: US 7,152,650 B2
(45) Date of Patent: Dec. 26, 2006

(54) TAPE DISPENSER

(75) Inventors: Peter R. Van Tyle, Skaneateles, NY (US); David L. Fergot, Syracuse, NY (US); Jose M. Martinez, Rocky River, OH (US)

(73) Assignee: Henkel Consumer Adhesives, Inc., Avon, OH (US)

( * ) Notice: Subject to any disclaimer, the term of this patent is extended or adjusted under 35 U.S.C. 154(b) by 18 days.

(21) Appl. No.: 10/609,221

(22) Filed: Jun. 27, 2003

(65) Prior Publication Data

US 2004/0011473 A1 Jan. 22, 2004

Related U.S. Application Data

(60) Provisional application No. 60/395,779, filed on Jul. 15, 2002.

(51) Int. Cl.
*B32B 37/22* (2006.01)

(52) U.S. Cl. ..... 156/527; 156/574; 156/577

(58) Field of Classification Search ..... 156/574, 156/577, 527

See application file for complete search history.

(56) References Cited

U.S. PATENT DOCUMENTS

| | | | | |
|---|---|---|---|---|
| 2,551,168 | A | 5/1951 | Rosen | |
| 2,728,477 | A | 12/1955 | Vogt | |
| 2,732,964 | A | 1/1956 | Neer | |
| 3,034,691 | A | 5/1962 | Gershen | |
| 3,035,345 | A * | 5/1962 | Barnard | 83/568 |
| 3,902,956 | A * | 9/1975 | Thompson, Jr. | 156/523 |
| 4,341,587 | A * | 7/1982 | Regan | 156/523 |
| 4,400,231 | A * | 8/1983 | Martin | 156/527 |
| 4,627,560 | A * | 12/1986 | Samuelson | 225/66 |
| 4,729,518 | A * | 3/1988 | Mathna et al. | 242/422.4 |
| 4,792,375 | A * | 12/1988 | Lin | 156/510 |
| 4,884,734 | A | 12/1989 | Kahl, Jr. et al. | |
| 4,961,525 | A | 10/1990 | Corbo et al. | |
| 5,071,051 | A | 12/1991 | Corbo et al. | |
| 5,468,332 | A * | 11/1995 | Dretzka et al. | 156/527 |
| 5,672,238 | A * | 9/1997 | Samuelson | 156/579 |
| 5,759,342 | A | 6/1998 | Luhman | |
| 5,792,310 | A * | 8/1998 | Thompson et al. | 156/523 |
| 5,820,005 | A | 10/1998 | Perkitny et al. | |
| 5,878,932 | A * | 3/1999 | Huang | 225/65 |
| D448,413 | S * | 9/2001 | Carlson et al. | D19/69 |
| 6,543,511 | B1 * | 4/2003 | Niermann | 156/527 |
| 6,612,474 | B1 * | 9/2003 | Shah | 225/51 |
| 6,874,554 | B1 * | 4/2005 | Chandaria | 156/527 |
| 2002/0069974 | A1 * | 6/2002 | Niermann | 156/577 |
| 2004/0149798 | A1 * | 8/2004 | Hoffman et al. | 225/46 |

FOREIGN PATENT DOCUMENTS

| | | |
|---|---|---|
| EP | 0 104 989 | 4/1984 |
| EP | 0 351 088 | 1/1990 |
| EP | 0 640 548 | 3/1995 |

(Continued)

*Primary Examiner*—Mark A. Osele
(74) *Attorney, Agent, or Firm*—Fay, Sharpe, Fagan, Minnich & McKee, LLP

(57) ABSTRACT

A tape dispenser comprises a cylindrical hub for rotatably supporting a roll of tape, and a dispensing arm extends radially outwardly of the hub and has a tape guide on the bottom thereof by which tape is arched concavely toward an underlying surface as the tape is displaced from the dispenser and applied to the underlying surface. A brake arrangement on the dispenser is operable manually by a user to stop or otherwise control rotation of a tape roll during a dispensing operation.

39 Claims, 4 Drawing Sheets

FOREIGN PATENT DOCUMENTS

| | | |
|---|---|---|
| GB | 673 055 | 5/1952 |
| JP | 8-119523 | 5/1996 |
| WO | WO 97 08087 | 3/1997 |

* cited by examiner

TAPE DISPENSER

This application claims priority under 35 U.S.C. §119(e) and the benefit of provisional patent application Ser. No. 60/395,779, filed Jul. 15, 2002 entitled TAPE DISPENSER which is incorporated herein by reference.

BACKGROUND OF THE INVENTION

This invention relates to the art of tape dispensers and, more particularly, to an improved tape dispenser which can be manipulated to apply a tape along a path with improved control of the dispensing and the location of an edge of the tape relative to the path.

The present invention finds particular utility in connection with the dispensing of masking tape and the application of such tape along the juncture between angularly related surfaces such as a window pane and a frame or mullion to be painted and, accordingly, will be disclosed and described herein in detail in connection with such use. At the same time, however, it will be appreciated that the dispenser can be used with tapes other than masking tape and in connection with the application of tape to any surface or along the juncture between adjacent angularly related surfaces with improved control of the location of an edge of the tape along the path of movement during the application thereof.

Handheld tape dispensers capable of being manipulated to apply tape to an underlying surface are of course well known, particularly in connection with the taping of a box or the like. It is likewise well known to use tape, and particularly masking tape, as a paint shield along the juncture between adjacent surfaces to protect the taped surface from being painted during the application of paint to the adjacent untaped surface. The adjacent surfaces can be coplanar, such as in the application of tape along a wall to provide a desired design in connection with the painting thereof. Most often, however, masking tape is used to protect one of adjacent, angularly related surfaces from being painted in connection with the application of paint to the other surface. Such angularly related surfaces can be defined, for example, by a windowpane and frame extending thereabout, by mullions between adjacent panes of glass, by the juncture between floors and molding, and the like.

Generally, masking tape is wound on a cardboard core and is sold in rolls and without a dispenser. Heretofore, the application of masking tape for purposes such as those mentioned above is achieved by pulling the free end of the tape away from the roll, holding the free end and the tape and roll in opposite hands, applying the free end to an underlying surface and progressively pressing the tape along the path of application while guiding the tape through the manipulation of the roll and cooperative movement of the fingers of the other hand to press the roll against the underlying surface. This process is not only time consuming and cumbersome in that it most often requires the withdrawal and re-application of the tape to the underlying surface in an effort to control the position of the tape edge along the adjacent surfaces. Moreover, this process makes it extremely difficult if not possible to maintain the tape edge straight and to avoid the occurrence of gaps between the tape edge and the adjacent surface. Such difficulties result from the instability of application caused by the user's one hand holding the tape roll and the other hand attempting to press the dispensed tape into place and the application of a varying pulling force on the tape roll during the tape applying procedure which is caused by the tape roll being handheld and thus grasped with different holding forces by the user during the application process. The end result is the creation of areas along the surface to be shielded which are not covered by the tape and, accordingly, receive paint during the application thereof to the adjacent surface.

Another problem encountered in connection with the taping of adjacent, angularly, related surfaces is encountered in cutting the tape at a corner between right angle surfaces such as window frame members. Attempting to tear the tape and position it in a corner is nearly impossible, and a good sharp corner requires cutting the tape at or a little short of the corner at one end and then beginning the adjacent right angle run by overlapping the previously cut end. This process is time consuming and, with regard to the first cut, usually requires pulling a portion of the tape away from the underlying surface in order to access the tape for cutting. Tape dispensers heretofore available which enable the application of tape from the dispenser onto an underlying surface require the tape to be withdrawn from the underlying surface at a corner and to twist the tape across a serrated cutting edge on the dispenser to sever the tape and after which the tape has to be reapplied into the corner. In pulling the tape up from the underlying surface, it is extremely difficult to control a handheld tape roll or a tape roll on a dispenser so as to avoid further dispensing of tape from the roll and the consequent extra length of tape which has to be withdrawn again and cut in an effort to conform with the corner edges. If the user cuts the tape too short, then more tape has to be applied in order to cover the corner area.

SUMMARY OF THE INVENTION

In accordance with the present invention, a tape dispenser is provided by which the foregoing and other problems and disadvantages encountered in connection with the application of tape along adjacent surfaces, either manually or through the use of a dispenser having tape applicating capability, are minimized or overcome. More particularly, a tape dispenser in accordance with the present invention enables tape to be applied along adjacent surfaces with accuracy of the linear positioning of an edge of the tape along the adjacent surfaces so as to avoid uncovered spaces on the underlying surface which are intended to be covered. This is achieved in part by controlling the contour of the tape as it is dispensed and applied onto the underlying surface, by stabilizing the tape applicating procedure through the use of an applicator portion of the dispenser in place of a user's fingers, and by enabling the tape to be pulled from the dispenser with a uniform pulling force applied thereto. More particularly, with regard to the tape contour, the dispenser includes a tape guide which serves to bow or arch the tape transverse to the direction of application thereof and as the tape exits the applicating end of the dispenser with the arcuate contour of the tape being concave in the direction from the dispenser toward the underlying surface. This contour rigidifies the tape against flexure or bending transverse to the direction of application much like that of an arched metal tape measure. With respect to so rigidifying, the tape contour could be convex as well as concave. Further, the arched contour provides for the edges of the tape to spread laterally outwardly as the tape is applied to the underlying surface, thus assuring the edge of the tape along the adjacent surfaces being positioned as desired with respect thereto. Accordingly, tape can be laid along a path between adjacent surfaces without having to repeatedly lift and reposition the tape during the application thereof. Moreover, even if lifting of the tape becomes necessary, the contour of the tape, the stability of the dispenser and its manipulation by the user enable the lifting and re-application to be more quickly and more accurately achieved than heretofore possible.

In accordance with a further aspect of the invention, the applicator is a molded, one-piece plastic component and the tape applicator at the exit end of the dispenser is provided with an integral serrated cutting edge which promotes the ability to apply the tape fully into a corner between right angled edges and to accurately cut the tape when it is fully into the corner. This capability avoids the need to repeatedly pull the tape away from the corner, cut and then reposition the tape with the hope that the tape has been cut to the appropriate length to fill the corner. In this respect, at the very least, the serrated cutting edge perforates the tape to provide an indication of the line along which the tape needs to be tom or cut in order to fill the corner.

In accordance with another aspect of the invention, the dispenser includes a tape roll supporting arrangement which enables a user to grasp and tightly support the dispenser without interfering with free rotation of the tape roll during a tape dispensing and applicating procedure.

In accordance with still another aspect of the invention, the dispenser includes a dispensing arm which includes a tape applicator at the exit end of the tape guide and spaced outwardly from the tape roll a distance sufficient to assure the ability to manipulate the dispenser in a corner between intersecting right angle surfaces to achieve the desired cutting and/or perforating of the end of the tape.

In accordance with yet a further aspect of the invention, the dispenser has a brake arrangement by which rotation of the tape roll can be stopped and/or otherwise controlled during a dispensing operation. This is particularly useful in connection with precluding the withdrawal or rewinding of tape relative to the roll when the tape has been marked by the cutting edge such as in a corner.

It is accordingly an outstanding object of the present invention to provide an improved dispenser for supporting a tape roll and enabling the application of tape therefrom with accurate control of an edge of the tape as it is being applied to an underlying surface.

Another object is the provision of a tape dispenser of the foregoing character by which the dispensing and application of tape onto an underlying surface for a given purpose can be achieved easier and more quickly than if done manually or through the use of dispensers and applicators heretofore available.

Yet another object is the provision of a tape dispenser of the foregoing character which controls the contour of the tape as it is dispensed and applied to an underlying surface in a manner whereby the center of the tape in the direction of application first engages the underlying surface and the laterally outer portions of the tape then spread laterally of the direction of application.

Still another object is the provision of a tape dispenser of the foregoing character which enables the application of a run of tape fully into a corner between adjacent right angle surfaces and the cutting or tearing of the tape such as to accurately fill the corner in the direction of application.

A further object is the provision of a hand manipulable dispenser for a roll of tape in which a brake arrangement is provided by which the user can stop and/or otherwise control the displacement of tape from the roll during a tape applying operation.

Another object is the provision of a tape dispenser of the foregoing character which is structurally simple, easy to provide with a tape roll and to manipulate in connection with the dispensing and application of tape from the roll onto an underlying surface.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
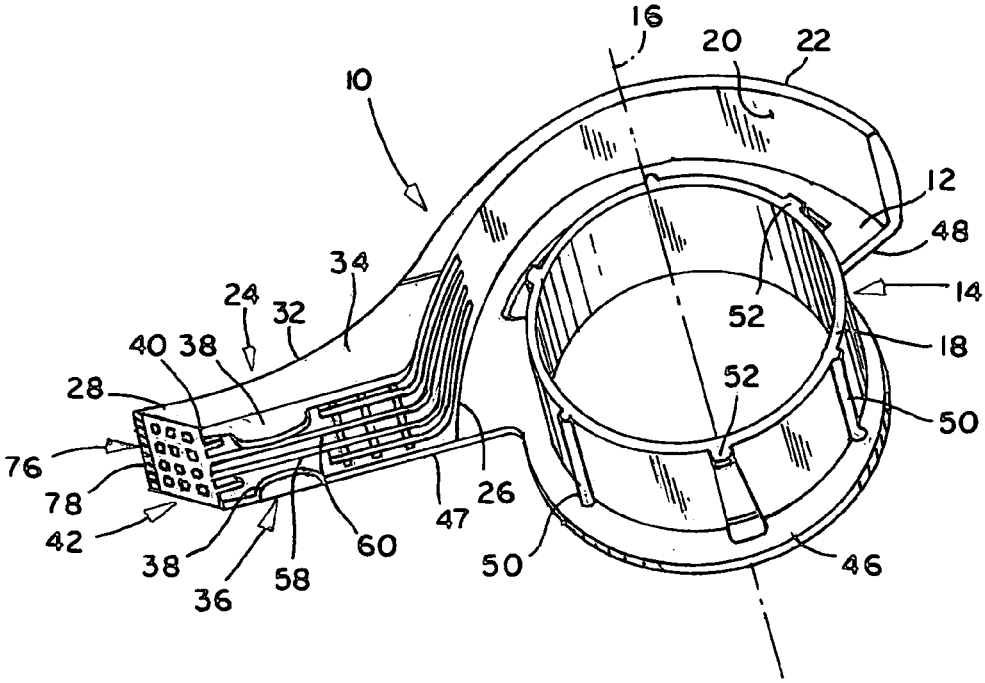
FIG. 1 is a perspective view of one side of a tape dispenser in accordance with the present invention.
Figure 2:
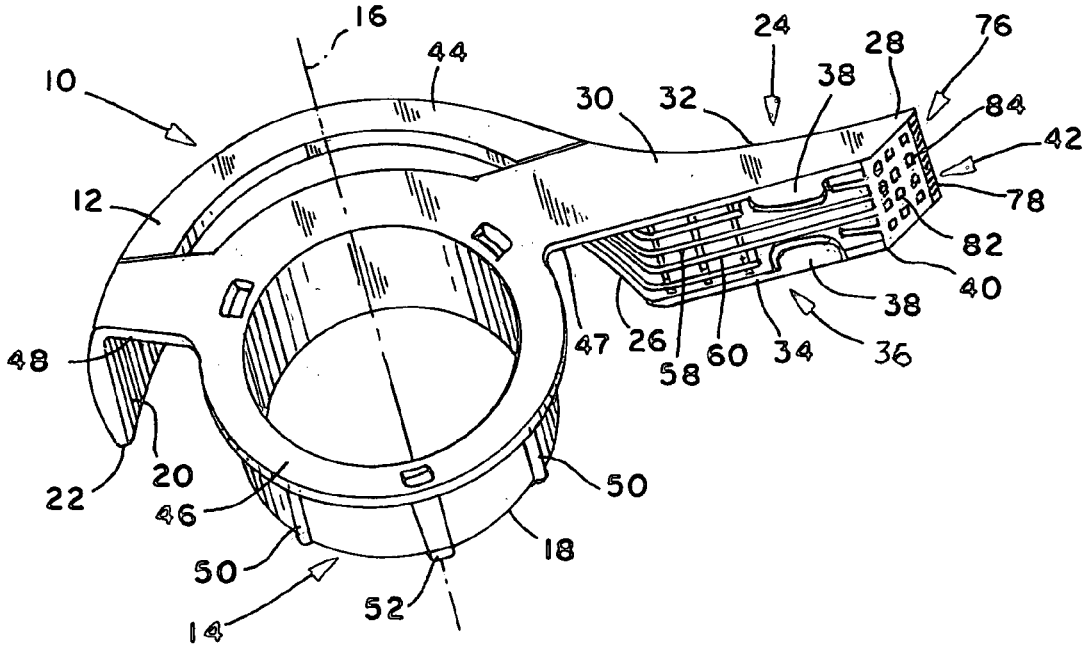
FIG. 2 is a perspective view of the opposite side of the dispenser.
Figure 10:
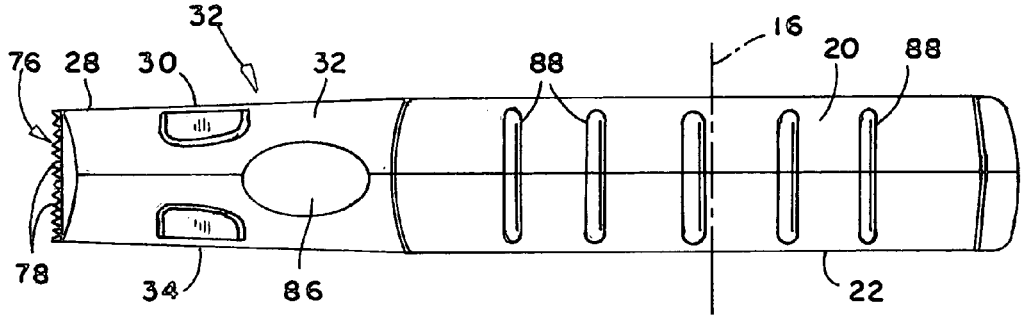
FIG. 10 is a top view of the applicator.

Referring now in greater detail to the drawings wherein the showings are for the purpose of illustrating preferred embodiments of the invention and not for the purpose of limiting the invention, a tape dispenser and applicator 10 in accordance with the present invention is produced from a suitable plastic material and includes a planar wall 12, a tape roll support in the form of an annular hub 14 extending transverse to wall 12 and having an axis 16 and an axially outer end 18 spaced from wall 12 a distance slightly greater than the width of a roll of tape to be mounted thereon. The dispenser further includes an arcuate wall 20 radially spaced from hub 14 a distance generally corresponding to and at least slightly greater than the radial thickness of a roll of tape to be mounted on the latter. Wall 20 extends transverse to planar wall 12 and has an axially outer end 22 generally axially coextensive with outer end 18 of hub 14. The dispenser further includes a dispensing arm 24 extending radially of hub 14 and axis 16 and having inner and outer ends 26 and 28, respectively, relative to hub 14. Dispensing arm 24 comprises a first arm wall 30 which is an integral part of planar wall 12 and extends radially outwardly of hub 14, a second arm wall 32 extending integrally from arcuate wall 20 to outer end 28 of the arm and transverse to wall 30, and a planar third arm wall 34 extending downwardly from the side of wall 32 parallel to wall 30. Dispensing arm 24 has a top defined by wall 32 and a bottom which provides a tape guide 36 as described in greater detail hereinafter. A tape retaining tab 38 extends laterally inwardly from each of the walls 30 and 34, and tape guide 36 has an outer end 40 from which a tape applicator 42 extends upwardly and forwardly with respect to the bottom edges 30*b* and 34*b* of walls 30 and 34, respectively.

Planar wall 12 includes an upper portion 44 extending partially about the circumference of hub 14 and having an arcuate window 45 therethrough. Wall 12 further includes a flange portion 46 extending circumferentially beneath the hub from bottom edge 47 at the front of wall portion 44 and the rear end 48 thereof. Hub 14 is provided with a plurality of axially extending ribs 50 circumferentially spaced apart about the outer periphery thereof for rotatably supporting the core of a roll of tape mounted on the hub for the roll to rotate relative to the hub with minimal frictional resistance, and the axially outer end 18 of the hub is provided with a plurality of radially outwardly extending roll retaining tabs 52 which axially retain a tape roll on the hub after it is mounted thereon by axially moving the tape roll core inwardly across tabs 52. It will be appreciated, of course, that a tape roll is mounted on hub 14 for dispensing therefrom in the direction of dispensing arm 24 with the adhesive side of the tape facing downwardly of tape guide 36 and between the tape guide and tape retaining tabs 38.

In accordance with one aspect of the present invention, and as best seen in FIGS. 5–10 of the drawing, tape guide 36 on the bottom of dispensing arm 24 functions to cause a tape T being dispensed to arch or curve transverse to the direction of dispensing as the tape is withdrawn from the roll and advanced toward outer end 28 of the dispensing arm. It will be appreciated, of course, that dispensing of the tape is with the adhesive side of the tape facing an underlying surface onto which the tape is to be applied. In the preferred embodiment disclosed herein, tape guide 36 for arching the tape has laterally opposite sides relative to dispensing arm 24 defined by ledges 54 and 56 respectively on inner sides 30*a* and 34*a* of walls 30 and 34 of the dispensing arm. Ledges 54 and 56, as will be appreciated from FIG. 9, extend forwardly in the direction from inner end 26 of the dispensing arm toward outer end 28 thereof and terminate at front edge 40 of the tape guide. As will be further appreciated from FIG. 9, the ledges incline downwardly and forwardly relative to the corresponding one of the bottom edges 30*b* and 34*b* of walls 30 and 34 so as to merge with the corresponding bottom edge at end 40. As will be appreciated from FIG. 6, the laterally outer sides 30*c* and 34*c* of walls 30 and 34 converge with respect to the corresponding inner side 30*a* and 34*a* in the direction from inner end 26 toward outer end 40 of the tape guide and converge at the latter end with the inner sides of the arm portions.

Tape guide 36 also includes a central portion laterally between and spaced below ledges 54 and 56 and which, in the embodiment disclosed, is defined by a pair of laterally adjacent ribs 58 and 60 depending from wall 32 and having bottom edges 62 and 64, respectively, which are spaced below ledges 54 and 56 and below outer end 40 of the tape guide. Ribs 58 and 60 extend from inner end 26 of the dispensing arm to outer end 40 of the tape guide and, preferably, the tape guide further includes ribs 66 and 68 between ribs 58 and 60 and the corresponding outer arm wall 30 and 34, respectively. Ribs 66 and 68 depend from wall 32 and have bottom edges 70 and 72, respectively, which are below ledges 54 and 56 and above lower ends 62 and 64 of ribs 58 and 60. Ribs 66 and 68 extend from inner end 26 of the dispensing arm to a point adjacent the inner ends of tape retaining tabs 38, and each of the ribs 58, 60, 66, and 68 includes an inner portion at inner end 26 extending upwardly into merging relationship with the inner surface of arcuate wall 20. A plurality of cross ribs 74 extend between laterally adjacent ones of the longitudinally extending ribs and at longitudinally spaced apart locations therealong. The tape guide ribs as well as the laterally extending ribs cooperatively reinforce the dispensing arm and rigidify the latter against unintended deflection during use of the dispenser.

Figure 6:
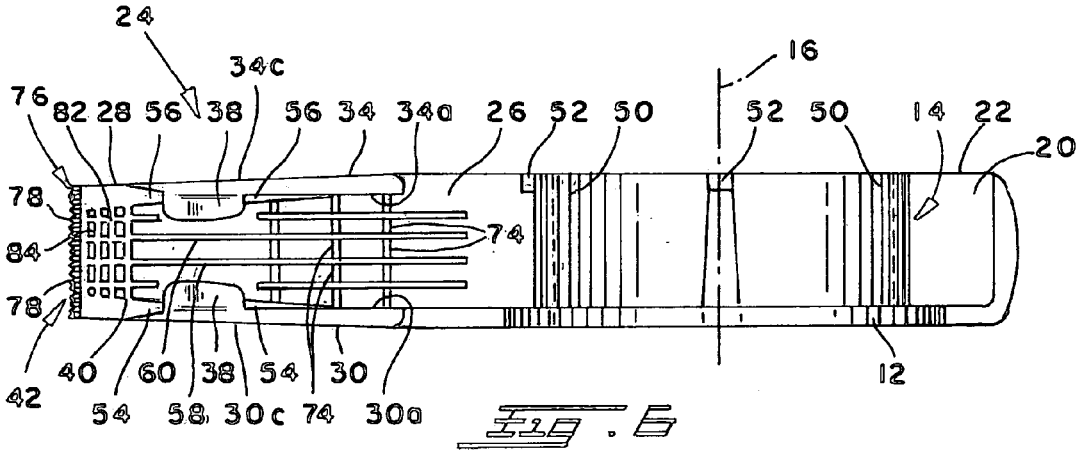
FIG. 6 is a bottom view of the dispenser.
Figure 4:
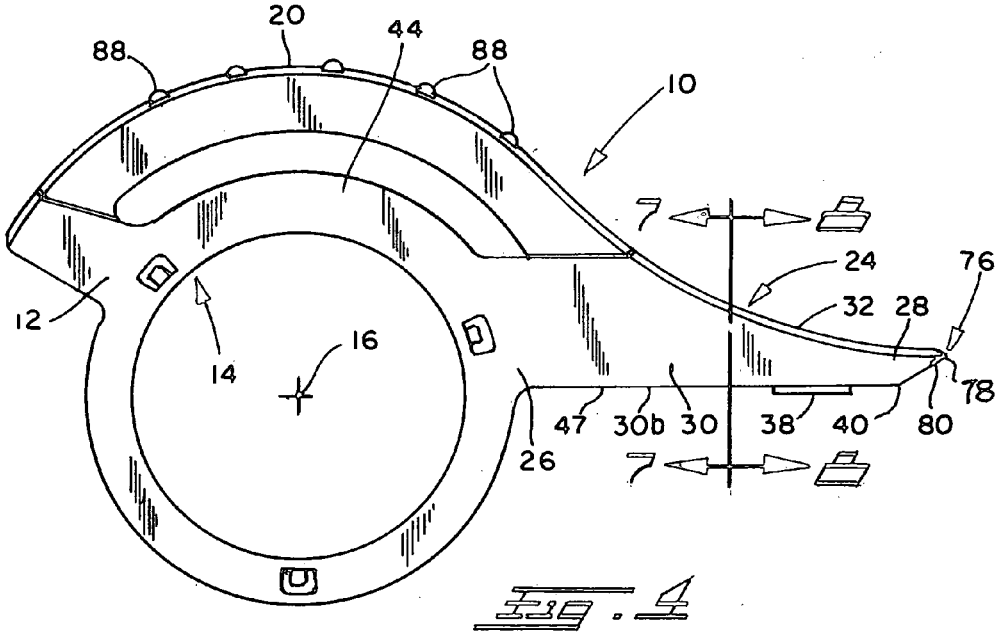
FIG. 4 is a side elevation view of the side of the dispenser seen in FIG. 2.
Figure 5:
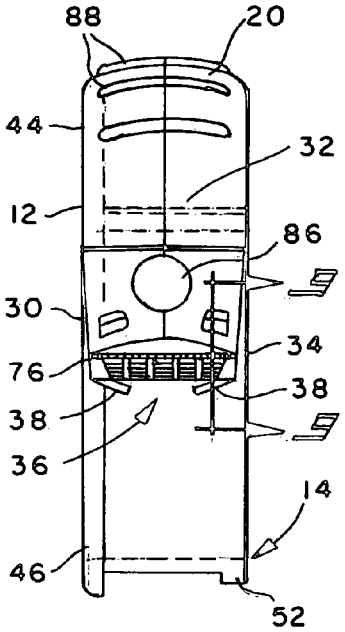
FIG. 5 is a front end elevation view of the dispenser.

As best seen in FIGS. 5 and 6, tape applicator 42 terminates in a serrated cutting edge 76 spaced forwardly of and parallel to outer end 40 of the tape guide. Serrated cutting edge 76 includes a plurality of cutting teeth 78 extending longitudinally into the outer end of applicator 42 and having laterally spaced apart parallel cutting edges 80. The tape applicator is defined in part by a plurality of longitudinally extending ribs 82 and a plurality of laterally extending ribs 84, all of which strengthen and rigidify the tape applicator against deflection and/or distortion during use of the tape dispenser. To facilitate manipulation of the tape dispenser during a dispensing and tape applying operation, top arm wall 32 is provided with an ovular depression 86 which accommodates a user's thumb when holding the dispenser, and arcuate wall 20 is provided with a plurality of longitudinally spaced apart laterally extending ribs 88 which serve to resist slippage between the dispenser and a user's hand during the dispensing and application of tape.

Figure 3:
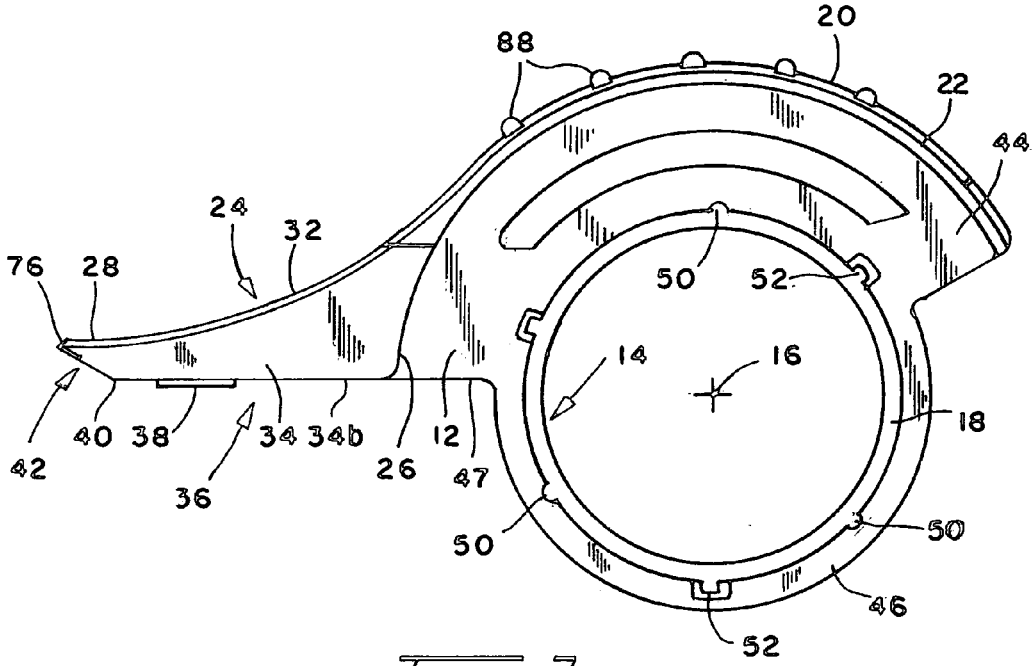
FIG. 3 is a side elevation view of the side of the dispenser shown in FIG. 1.
Figure 7:
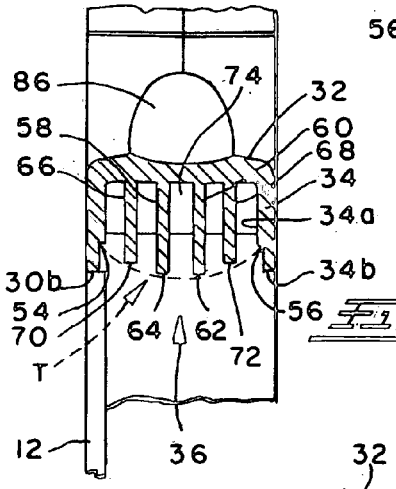
FIG. 7 is a cross-sectional elevation view of the dispenser taken along line 7—7 in FIG. 4.
Figure 8:
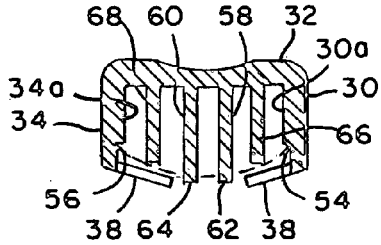
FIG. 8 is a cross-sectional elevation view of the dispensing arm taken along line 8—8 in FIG. 4.
Figure 9:
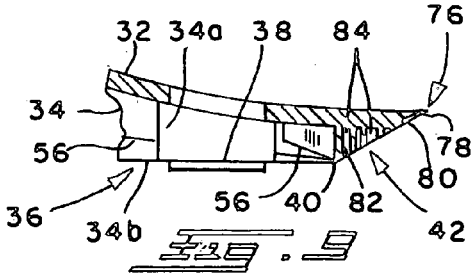
FIG. 9 is a detailed sectional elevation view taken along line 9—9 in FIG. 5.

In use, as will be appreciated from the foregoing description and with reference in particular to FIGS. 3, 5 and 7 of the drawing, a roll of tape is mounted on hub 14 of the dispenser by pushing the core of the tape roll across tabs 52 which, when the core is moved fully onto the hub, are positioned to engage the outer end of the core to retain the tape roll on the hub. The tape roll is mounted on the hub for the adhesive side of the tape to face downwardly of dispensing arm 24, and the tape is unwound from the roll and pulled forwardly beneath tape guide 36 toward outer end 28 of the dispensing arm with the laterally opposite sides of the tape being introduced between the tape guide and tape retaining tabs 38. The dispenser is then ready to be used for the dispensing and applying of tape onto an underlying surface. Top wall 20 and portion 44 of wall 12 cooperatively provide a handle with hub 14 by which a user grasps and supports the dispenser, and tape is dispensed and applied onto an underlying surface by pressing applicator 42 against the back side of the tape and then pulling the dispenser along the underlying surface in the direction to unwind tape from the tape roll. As the dispenser is pulled in the foregoing manner, applicator 42 moves along the tape and continuously presses the latter against the underlying surface. Importantly in accordance with the invention, and as will be appreciated from FIGS. 7 and 8, the tape guide arches the tape such that the central portion thereof is engaged with the underlying surface as end 40 of the tape guide moves along the outer surface of the tape, after which the laterally outer portions of the tape flatten out and are pressed against the underlying surface by applicator 42. Further, as will be appreciated from FIG. 6, the tapering of the outer sides of walls 30 and 34 of the dispensing arm to merge with ledges 54 and 56 at end 40 of the tape guide provides for the laterally opposite edges of the flattened tape to be laid along the juncture between right angled surfaces without a gap therebetween. As the arched tape flattens out in leaving outer end 40 of the tape guide, the curvature provides for the tape to spread laterally so as to fill the gap that would result from unwinding and applying the tape in a totally planar condition. This together with the taper and merging of the ledges and side walls optimizes the application of tape without a gap between the underlying surface to be protected and an adjacent surface to be painted. When the dispenser and applicator reaches a corner, such as between a pane of glass and window frame components, the dispenser can be manipulated for serrated edge 76 to engage downwardly against the tape in the corner so as to cut or perforate the tape, the latter providing a clearly visible line of delineation enabling cutting or tearing of the tape and the laying of the cut end fully into the corner. Advantageously in connection with dispensing the tape, the arching or bowing thereof rigidifies the tape against bending along a line transverse to the opposite side edges of the tape. More particularly in this respect, the arching supports a length of the tape in a manner similar to that of rolled measuring tapes which can be withdrawn a considerable distance from a housing therefor without bending transverse to the direction of extension. With respect to so rigidifying, the tape contour could be convex as well as concave.

Figure 11:
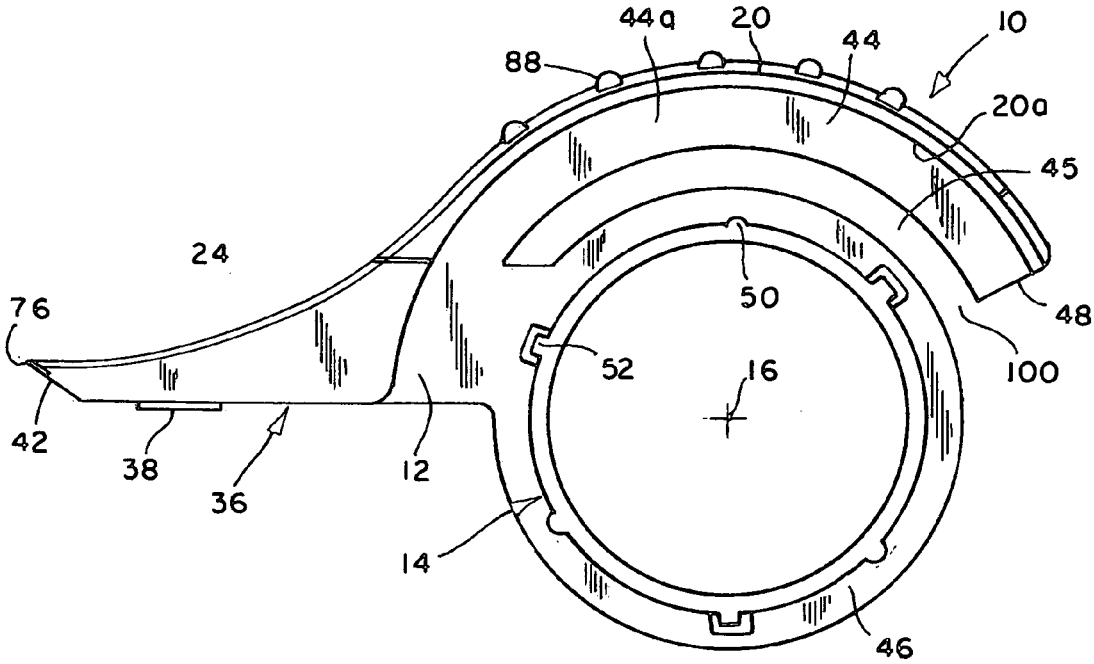
FIG. 11 is a side elevation view, similar to FIG. 4, showing a modification of the tape dispenser providing a tape roll brake.

In accordance with another aspect of the present invention, a tape dispenser, especially for masking tape, is provided with a brake arrangement enabling a user of the dispenser to stop the dispensing and/or to control the force required to pull tape from the roll during dispensing of the tape onto an underlying surface. One such brake arrangement is shown in FIG. 11 of the drawing as a modification of tape dispenser 10 described hereinabove in connection with FIGS. 1–10, whereby like numerals are used in FIG. 11 to designate corresponding components of the tape dispenser. In FIG. 11, the brake arrangement is provided by extending arcuate window 45 in upper wall portion 44 rearwardly so as to have an open end 100 at rear edge 48 of wall portion 44. This provides for arcuate top wall 20 and the adjacent uppermost portion 44*a* of wall portion 44 to be flexible radially inwardly of axis 16 and hub 14 against the inherent resiliency of the plastic material from which the dispenser is made. Thus, it will be appreciated that during a tape dispensing and applying operation the user can radially squeeze hub 14 and the arcuate upper wall portions such that the radially inner side 20*a* of wall 20 engages the radially outermost convolution of the tape, thereby pressing the cardboard core of the tape roll against hub 14 to stop or retard the rate of dispensing of tape from the roll.

Figure 12:
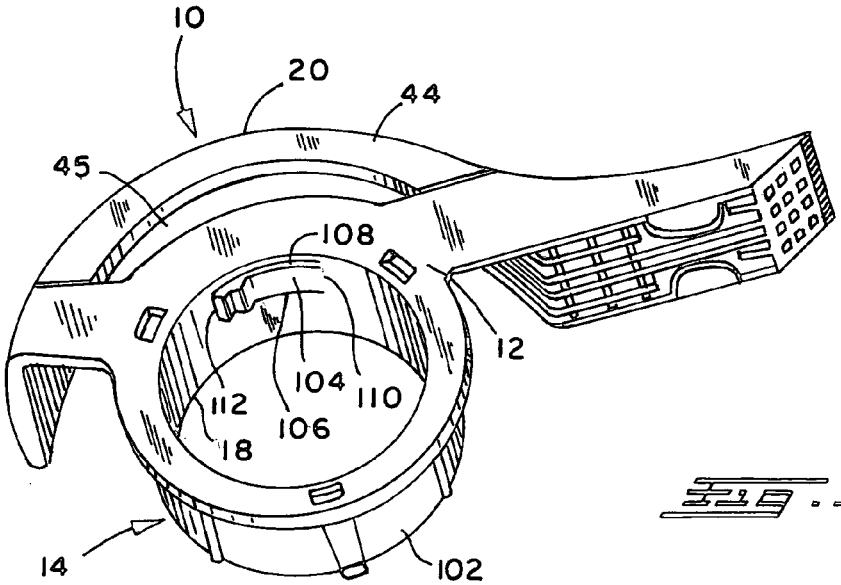
FIG. 12 is a perspective view, similar to FIG. 2, showing another embodiment of a tape roll brake; and, FIG. 13 is a detailed cross-sectional elevation view of the tape roll brake shown in FIG. 12.
Figure 13:
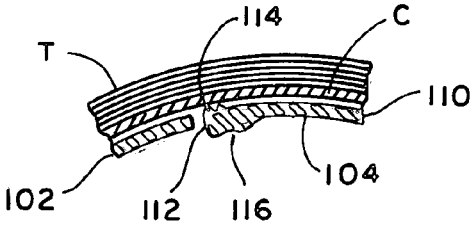

Another embodiment of a brake arrangement is shown in FIGS. 12 and 13 of the drawing, again in connection with the tape dispenser described hereinabove, whereby like numerals appear in FIGS. 12 and 13 to identify corresponding parts of the dispenser. In this embodiment, annular wall portion 102 of hub 14 is provided with a brake arm 104 radially beneath arcuate wall 20 and upper wall portion 44 of the dispenser. Brake arm 104 is defined by axially spaced apart parallel sides 106 and 108 extending circumferentially of hub wall 102 from an end 110 which is integral with hub wall 102, and the brake arm includes an end face 112 extending transversely between sides 106 and 108. Side 106 is spaced axially inwardly from outer end 18 of hub 14 and, preferably, side 108 extends along the intersection between hub wall 102 and planar wall 12 of the dispenser. Preferably, the free end of brake arm 104 is provided on the radially outer side thereof with a serrated or otherwise textured surface 114, and the radially inner side of the free end is radially enlarged and contoured to provide a profile 116 to accommodate a user's finger. When a roll of tape is mounted on hub 14 the cardboard core C thereof overlies and is rotatable relative to hub 14 and thus brake arm 104. Accordingly, it will be appreciated that a user of the dispenser can displace the free end of brake arm 104 radially outwardly of the hub against core C to stop and/or otherwise control rotation of the tape roll during dispensing of tape therefrom by displacing the diametrically opposing side of the core radially against hub 14.

While considerable emphasis has been placed herein on the structure of a preferred embodiment of the invention, it will be appreciated that many changes can be made in the preferred embodiment and that other embodiments can be made without departing from the principles of the invention. In this respect in particular, it will be appreciated that the tape guide can be defined by a continuous arced or bowed surface as opposed to a plurality of ribs and ledges and that, in the preferred embodiment, more or less ribs can be provided to form the tape guide. Further, while it is preferred that the hub be circular and uninterrupted circumferentially, it will be appreciated that other structures can be provided for supporting a tape roll for rotation relative to the dispenser. Still further while the brake arrangements are disclosed in conjunction with a dispenser having a tape guide according to the invention, it will be appreciated that a tape guide is not essential to the operation of the brake. These and other changes in the preferred embodiment as well as other embodiments will be obvious and suggested to those skilled in the art from the disclosure herein, whereby the foregoing descriptive matter is to be interrupted merely as illustrative of the present invention and not as a limitation.

Having thus described the invention, it is so claimed:

1. A tape dispenser comprising a support for a roll of tape and a dispensing arm extending radially of said support and having a top and a bottom, said bottom including a tape guide having laterally spaced apart opposite sides and a central portion between and spaced below said sides, said bottom of said guide having inner and outer ends with respect to said support, said tape guide including a plurality of ribs extending in the direction between said inner and outer ends, and said central portion including a pair of central ribs extending from said inner end to said outer end; said ribs adapted to support a tape to be dispened.

2. The tape dispenser of claim 1, wherein said opposite sides of said tape guide include ledges extending in said direction.

3. The tape dispenser of claim 1, wherein said plurality of ribs includes a rib laterally outwardly adjacent each of said central ribs, said laterally outwardly adjacent ribs being in said laterally spaced apart opposite sides.

4. The tape dispenser of claim 3, wherein said opposite sides of said tape guide include ledges extending in said direction.

5. A tape dispenser comprising a support for a roll of tape and a dispensing arm extending radially of said support and having a top and a bottom, said bottom including a tape guide having laterally spaced apart opposite sides and a central portion between and spaced below said sides, said bottom of said arm having inner and outer ends with respect to said support, said tape guide including a plurality of ribs extending in the direction between said inner and outer ends, said central portion including a pair of central ribs extending from said inner end and terminating at said outer end, said plurality of ribs including a rib laterally outwardly adjacent each of said central ribs, said opposite sides of said tape guide including ledges extending in said direction, and a tape retaining tab extending inwardly in overlying relation to each of the opposite sides of said tape guide.

6. A tape dispenser comprising a support for a roll of tape and a dispensing arm extending radially of said support and having a top and a bottom, said bottom including a tape guide having laterally spaced apart opposite sides and a central portion between and spaced below said sides, said bottom of said arm having inner and outer ends with respect to said support, said tape guide including a plurality of ribs extending in the direction between said inner and outer ends, said central portion including a pair of central ribs extending from said inner end and terminating at said outer end, said plurality of ribs including a rib laterally outwardly adjacent each of said central ribs, said opposite sides of said tape guide including ledges extending in said direction, and a tape retaining tab extending inwardly in overlying relation to each of the opposite sides of said tape guide, the ribs laterally outwardly adjacent said central ribs extending from said inner end of said bottom and terminating adjacent said tape retaining tabs.

7. The tape dispenser of claim 6, wherein said ledges have inner ends spaced forwardly of said inner end of said bottom and terminate at said outer end of said bottom.

8. The tape dispenser of claim 1, further including a manually operable brake for restraining rotation of a tape roll mounted on said support.

9. The tape dispenser of claim 8, wherein said support includes a hub for rotatably receiving a tape roll, said brake including a wall overlying said hub and being displaceable toward said hub.

10. A tape dispenser comprising a support for a roll of tape and a dispensing arm extending radially of said support and having atop and a bottom, said bottom including a tape guide having laterally spaced apart opposite sides and a central portion between and spaced below said sides, said bottom of said arm having inner and outer ends with respect to said support and said arm including side walls between said top and bottom thereof, said side walls having outer and inner sides, said inner sides providing said opposite sides of said tape guide, and said outer sides converging in the direction from said inner end of said tape guide toward said outer end thereof.

11. The tape dispenser of claim 10, wherein said outer and inner sides of said side walls merge adjacent said outer end of said tape guide.

12. A tape dispenser comprising a support for a roll of tape and a dispensing arm extending radially of said support and having a top and a bottom, said bottom including a tape guide having laterally spaced apart opposite sides and a central portion between and spaced below said sides, said support being an annular hub and said bottom of said arm being spaced from and extending radially of said hub, said bottom of said arm having inner and outer ends with respect to said support and said arm including side walls between said top and bottom thereof, said side walls having outer and inner sides, said inner sides providing said opposite sides of said tape guide, and said outer sides converging in the direction from said inner end of said tape guide toward said outer end thereof and merging adjacent said outer end of said tape guide.

13. The tape dispenser of claim 12, and a tape applicator outwardly of said outer end of said tape guide having a serrated cutting edge.

14. The tape dispenser of claim 13, wherein said central portion includes a pair of central ribs extending from said inner end and terminating at said outer end and wherein said opposite sides of said tape guide include ledges extending in said direction.

15. The tape dispenser of claim 14, wherein said tape guide further includes a rib laterally outwardly adjacent each of said central ribs.

16. The tape dispenser of claim 15, and a tape retaining tab extending inwardly in overlying relation to each of the opposite sides of said tape guide.

17. The tape dispenser of claim 16, wherein the ribs laterally outwardly adjacent said central ribs extend from said inner end of said bottom and terminate adjacent said tape retaining tabs and wherein said ledges have inner ends spaced forwardly of said inner end of said bottom and terminate at said outer end of said bottom.

18. The tape dispenser of claim 12, wherein said central portion includes a pair of central ribs extending from said inner end and terminating at said outer end.

19. The tape dispenser of claim 18, wherein said tape guide further includes a rib laterally outwardly adjacent each of said central ribs.

20. The tape dispenser of claim 19, and a tape retaining tab extending inwardly in overlying relation to each of the opposite sides of said tape guide.

21. The tape dispenser of claim 20, wherein the ribs laterally outwardly adjacent said central ribs extend from said inner end of said bottom and terminate adjacent said tape retaining tabs.

22. The tape dispenser of claim 12, further including a manually operable brake for restraining rotation of a tape roll mounted on said support.

23. The tape dispenser of claim 22, wherein said support includes a hub for rotatably receiving a tape roll, said brake including a wall overlying said hub and being displaceable toward said hub.

24. A tape dispenser comprising a planar wall, a tape roll support extending transverse to said wall and having an axis and an end spaced from said planar wall, an arcuate wall extending transverse to said planar wall and being radially spaced from said tape roll support and overlying a portion thereof, said planar wall including a first arm portion extending radially outwardly of said tape roll support, a second arm portion extending from said arcuate wall transverse to said first arm portion and having an end spaced toward said end of said tape roll support, a planar third arm portion extending from said end of said second arm portion parallel to said first arm portion, said first and third arm portions having opposed inner sides and bottom edges, a tape guide adapted to support a tape to be dispensed between said inner sides including laterally opposite sides and a central portion between and spaced below said laterally opposite side.

25. The tape dispenser of claim 24, further including a manually operable brake for restraining rotation of a tape roll mounted on said support.

26. The tape dispenser of claim 25, wherein said support includes a hub for rotatably receiving a tape roll, said brake including a wall overlying said hub and being displaceable toward said hub.

27. The tape dispenser of claim 24 wherein said guide central portion comprises a pair of central ribs extending from said guide inner end to said guide outer end and said tape guide sides comprise ribs laterally adjacent said central ribs.

28. A tape dispenser comprising a planar wall, a tape roll support extending transverse to said wall and having an axis and an end spaced from said planar wall, an arcuate wall extending transverse to said planar wall and being radially spaced from said tape roll support and overlying a portion thereof, said planar wall including a first arm portion extending radially outwardly of said tape roll support, a second arm portion extending from said arcuate wall transverse to said first arm portion and having an end spaced toward said end of said tape roll support, a planar third arm portion extending from said end of said second arm portion parallel to said first arm portion, said first and third arm portions having opposed inner sides and bottom edges, a tape guide between said inner sides including guide surfaces on said inner sides and a central portion between and spaced below said guide surfaces, said guide surfaces including ledges extending along said inner sides of said first and third arm portions, and said tape guide having an end spaced from said tape roll support, said ledges terminating at said end of said tape guide, and said ledges being inclined downwardly and outwardly relative to said bottom edges of said first and third arm portions and merging with the bottom edges at said end of said tape guide.

29. The tape dispenser of claim 28, wherein said first and third arm portions have outer sides converging with respect to the corresponding inner side in the direction of said end of said tape guide.

30. The tape dispenser of claim 29, wherein the outer and inner sides of each said first and third arm portions merge adjacent said end of said tape guide.

31. The tape dispenser of claim 30 , wherein said central portion of said tape guide includes at least one rib depending from said second arm portion parallel to said first and third arm portions.

32. The tape dispenser of claim 31, wherein said tape guide further includes a rib depending from said second arm portion between said central portion and the inner side of each said first and third arm portions and parallel to the corresponding inner side.

33. The tape dispenser of claim 32, wherein said central portion includes a pair of ribs, said tape guide has an inner end, said pair of ribs and the ribs between the central portion and inner sides of said first and third arm portions extending forwardly from said inner end, and said pair of ribs terminating at said end of said tape guide.

34. The tape dispenser of claim 33, and a tape retaining tab extending inwardly of the bottom edge of each said first and third arm portion and rearwardly of said end of said tape guide.

35. The tape dispenser of claim 34, and a tape applicator extending from said end of said bottom edges of said first and third arm portions.

36. The tape dispenser of claim 35, wherein said tape applicator includes a serrated cutting edge between said first and third arm portions.

37. The tape dispenser of claim 36, wherein said tape roll support includes a cylindrical hub.

38. A tape dispenser comprising a support for a roll of tape and a dispensing arm extending radially of said support and having a top and a bottom, said bottom including a tape guide having laterally spaced apart opposite sides and a central portion between and spaced below said sides, said bottom of said arm having inner and outer ends with respect to said support, said tape guide including a plurality of ribs extending in the direction between said inner and outer ends, and said central portion including a pair of central ribs extending from said inner end and terminating at said outer end, and a tape retaining tab extending inwardly in overlying relation to each of the opposite sides of said tape guide.

39. A tape dispenser comprising a support for a roll of tape and a dispensing arm extending radially of said support and having a top and a bottom, said bottom including a tape guide having laterally spaced apart opposite sides and a central portion between and spaced below said sides, said bottom of said arm having inner and outer ends with respect to said support, said tape guide including a plurality of ribs extending in the direction between said inner and outer ends, and said central portion including a pair of central ribs extending from said inner end and terminating at said outer end, a tape retaining tab extending inwardly in overlying relation to each of the opposite sides of said tape guide, and ribs laterally outwardly adjacent said central ribs and extending from said inner end of said bottom and terminating adjacent said tape retaining tabs.

* * * * *

UNITED STATES PATENT AND TRADEMARK OFFICE

CERTIFICATE OF CORRECTION

PATENT NO. : 7,152,650 B2
APPLICATION NO. : 10/609221
DATED : December 26, 2006
INVENTOR(S) : Van Tyle et al.

It is certified that error appears in the above-identified patent and that said Letters Patent is hereby corrected as shown below:

Column 9, line 26, delete “atop” and insert therefor --a top--.

Column 10, line 42, delete “side” and insert therefor --sides--

Signed and Sealed this

Tenth Day of April, 2007

JON W. DUDAS
*Director of the United States Patent and Trademark Office*